US007073358B1

(12) United States Patent
Lee

(10) Patent No.: US 7,073,358 B1
(45) Date of Patent: Jul. 11, 2006

(54) SELF-LOCKING CABLE LOCK

(75) Inventor: Miko Lee, Hsin Chuang (TW)

(73) Assignee: Grace LIN, Hsin Chuang (TW)

( * ) Notice: Subject to any disclaimer, the term of this patent is extended or adjusted under 35 U.S.C. 154(b) by 0 days.

(21) Appl. No.: 11/313,676

(22) Filed: Dec. 22, 2005

(51) Int. Cl.
*E05B 65/00* (2006.01)

(52) U.S. Cl. ..... 70/58; 70/14; 70/57; 70/491; 248/551

(58) Field of Classification Search ..... 70/57, 70/14, 18, 58, 491; 248/551
See application file for complete search history.

(56) References Cited

U.S. PATENT DOCUMENTS 4,057,984 A * 11/1977 Avaiusini ..... 70/58
5,133,203 A 7/1992 Huang
5,327,752 A * 7/1994 Myers et al. ..... 70/58
5,381,685 A 1/1995 Carl et al.
5,493,878 A 2/1996 Murray, Jr. et al.
5,502,989 A 4/1996 Murray, Jr. et al.
5,787,739 A 8/1998 Derman
5,836,183 A 11/1998 Derman
5,913,907 A * 6/1999 Lee ..... 70/58
6,000,251 A 12/1999 Murray, Jr. et al.
6,000,252 A 12/1999 Murray, Jr. et al.
6,006,557 A 12/1999 Carl et al.
6,038,891 A 3/2000 Zeren et al.
6,112,561 A 9/2000 Carl
6,112,562 A 9/2000 Murray, Jr. et al.
6,155,088 A 12/2000 Murray, Jr. et al.
6,173,591 B1 1/2001 Derman
6,244,080 B1 * 6/2001 Sakurai ..... 70/14
6,257,029 B1 * 7/2001 Liao ..... 70/58
6,295,847 B1 10/2001 Zeren
6,301,940 B1 10/2001 Derman et al.
6,463,770 B1 * 10/2002 Lee ..... 70/58
6,513,350 B1 2/2003 Hurd et al.
6,553,794 B1 4/2003 Murray, Jr. et al.
6,588,241 B1 7/2003 Murray, Jr. et al.
6,591,642 B1 7/2003 Kuo
6,662,602 B1 12/2003 Carl
6,735,990 B1 5/2004 Murray, Jr. et al.
6,758,069 B1 7/2004 Derman
6,886,376 B1 * 5/2005 Kuo ..... 70/58
6,971,254 B1 * 12/2005 Bellow et al. ..... 70/14
6,973,809 B1 * 12/2005 Chang ..... 70/58

* cited by examiner

*Primary Examiner*—Brian E. Glessner
*Assistant Examiner*—William Schrode
(74) *Attorney, Agent, or Firm*—Bacon & Thomas

(57) ABSTRACT

A self-locking cable lock has a main shell, an external sleeve, an internal sleeve, a lock shell, a lock cylinder and a lock actuating assembly. The external sleeve is mounted in the main shell and has a stationary protruding rod extending out of the main shell. The internal sleeve is mounted in the external sleeve, is allowed to move axially relative to the external sleeve and has two movable protruding rods. The movable protruding rods extend out of the external sleeve and have inclined distal ends. The lock cylinder is mounted in the lock shell. The lock actuating assembly is mounted in the lock cylinder. The stationary protruding rod is pushed into a keyhole of a desired appliance and the movable protruding rods can be pressed to move axially. Then the cable lock is able to be self-locking.

9 Claims, 7 Drawing Sheets

SELF-LOCKING CABLE LOCK

BACKGROUND OF THE INVENTION

1. Field of the Invention

The present invention relates to a cable lock, especially to a self-locking cable lock.

2. Description of the Prior Arts

Cable locks are attached securely to cables that bind, lock and hold objects securely. Generally speaking, small, high value, pilferable objects such as computers, household appliances and the like on display need to be locked in place. Cable locks are used to keep the objects from being stolen. However, conventional cable locks must be locked and unlocked with keys. Using keys to lock conventional cable locks on objects is inconvenient because the keys must be controlled and protected.

To overcome the shortcomings, the present invention provides a self-locking cable lock to mitigate or obviate the aforementioned problems.

SUMMARY OF THE INVENTION

The main objective of the present invention is to provide a self locking cable lock. The self-locking cable lock has a main shell, an external sleeve, an internal sleeve, a lock shell, a lock cylinder and a lock actuating assembly. The external sleeve is mounted in the main shell and has a stationary protruding rod extending out of the main shell. The internal sleeve is mounted in the external sleeve, is allowed to move axially relative to the external sleeve and has two movable protruding rods. The movable protruding rods extend out of the external sleeve and have inclined distal ends. The lock cylinder is mounted in the lock shell. The lock actuating assembly is mounted in the lock cylinder. The stationary protruding rod is pushed into a keyhole of a desired appliance and the movable protruding rods can be pressed to move axially. Then the cable lock is able to be self locking.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
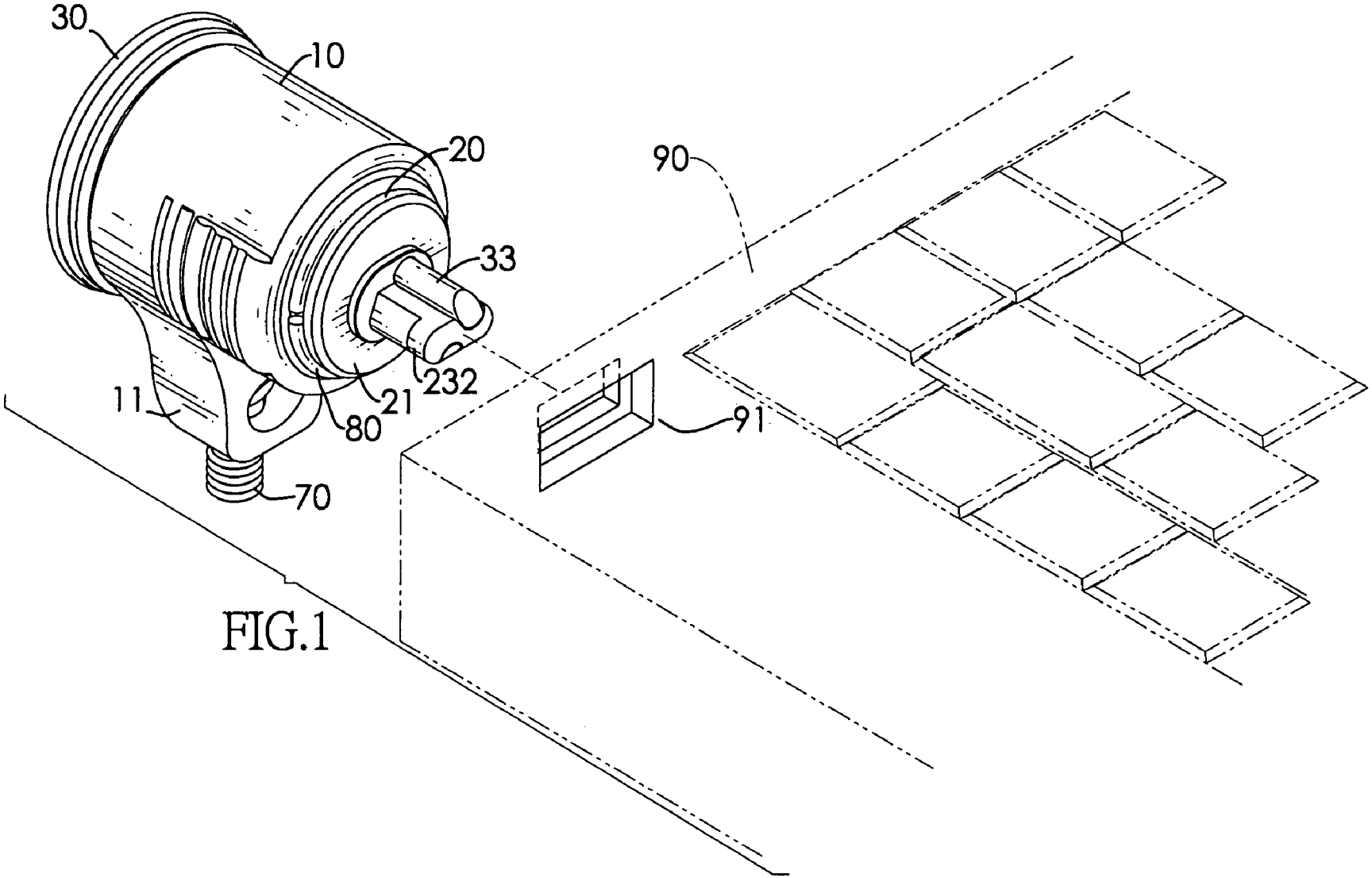
FIG. 1 is an exploded perspective view of a part of a computer and a self-locking cable lock in accordance with the present invention.
Figure 2:
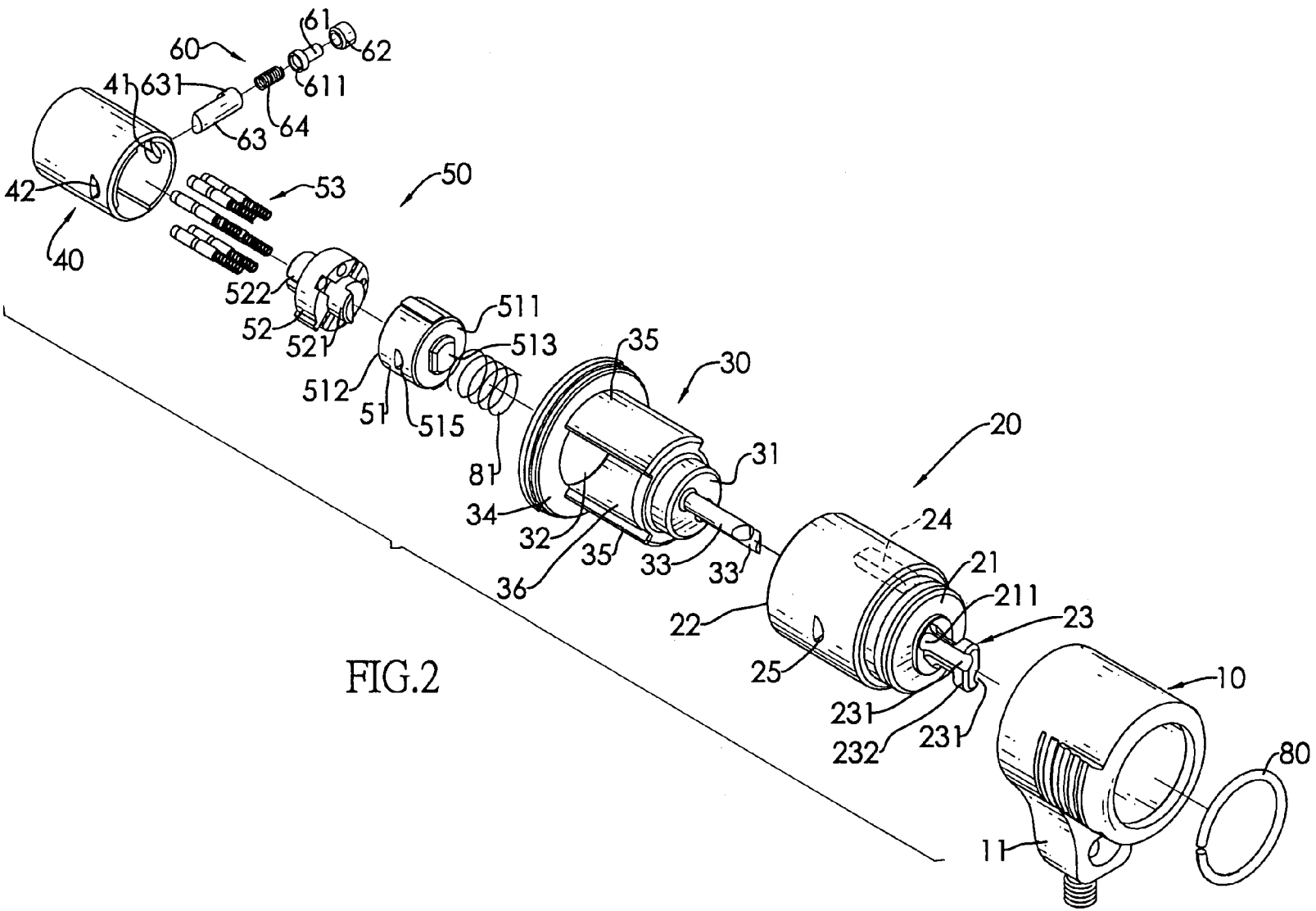
FIG. 2 is an exploded perspective view of the self-locking cable lock in FIG. 1.
Figure 4:
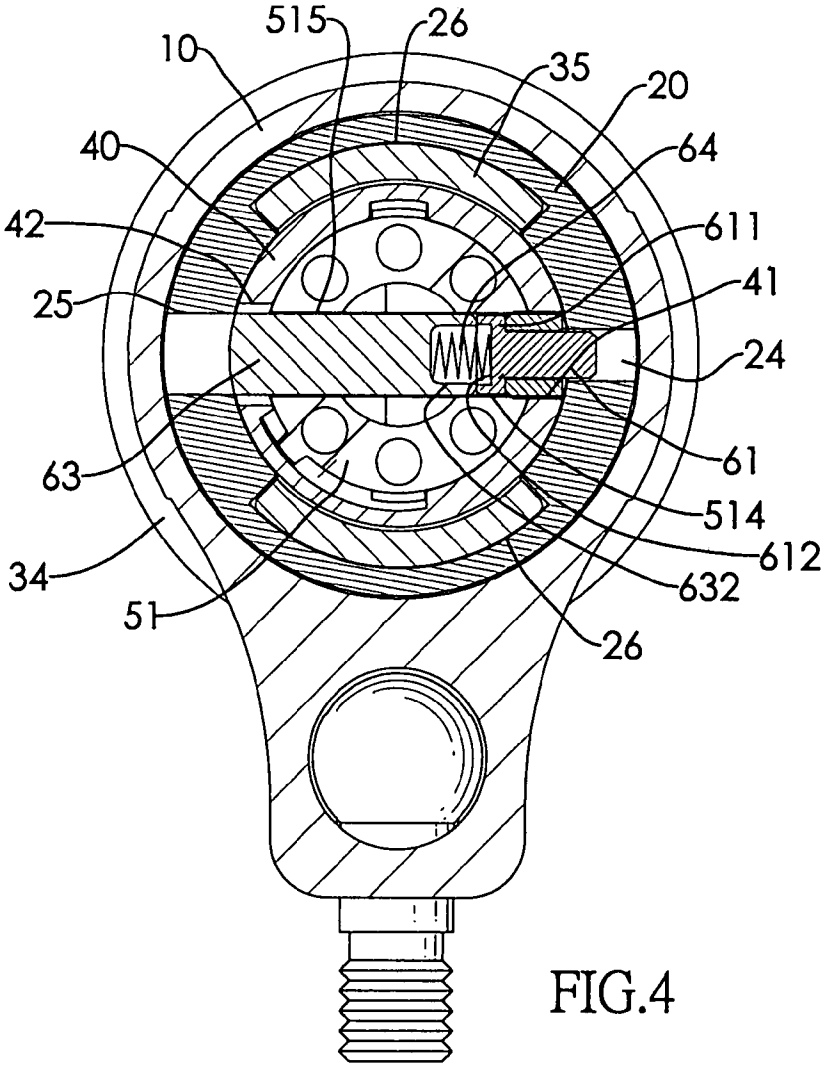
FIG. 4 is an operational rear view in partial section of the self-locking cable lock in FIG. 1 when the cable lock is unlocked.

With reference to FIGS. 1 and 2, a self-locking cable lock in accordance with the present invention comprises a cable (70), a main shell (10), an external sleeve (20), an internal sleeve (30), a lock shell (40), a lock cylinder (50) and a lock actuating assembly (60).

The main shell (10) is tubular, is attached to the cable (70) and may have two opening ends, a sidewall and a joint (11). The joint (11) is formed on the sidewall of the main shell (10) and is attached to the cable (70).

Figure 3:
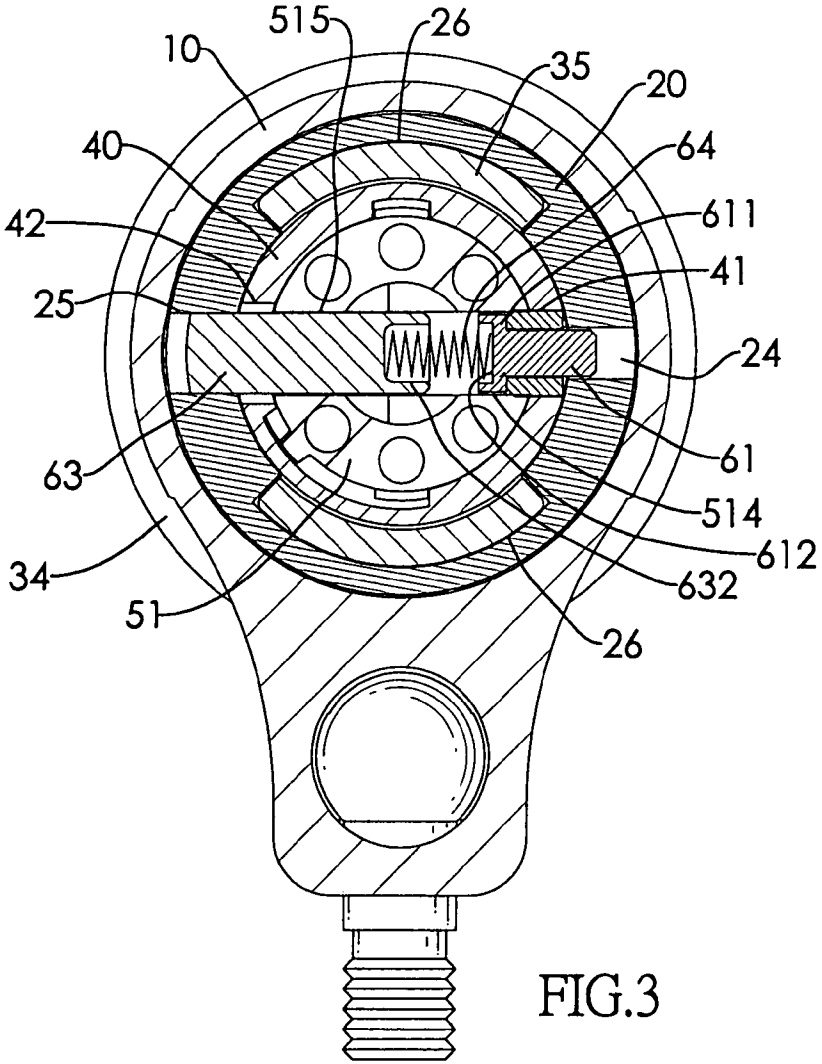
FIG. 3 is an operational rear view in partial section of the self-locking cable lock in FIG. 1 when the cable lock is locked.
Figure 5:
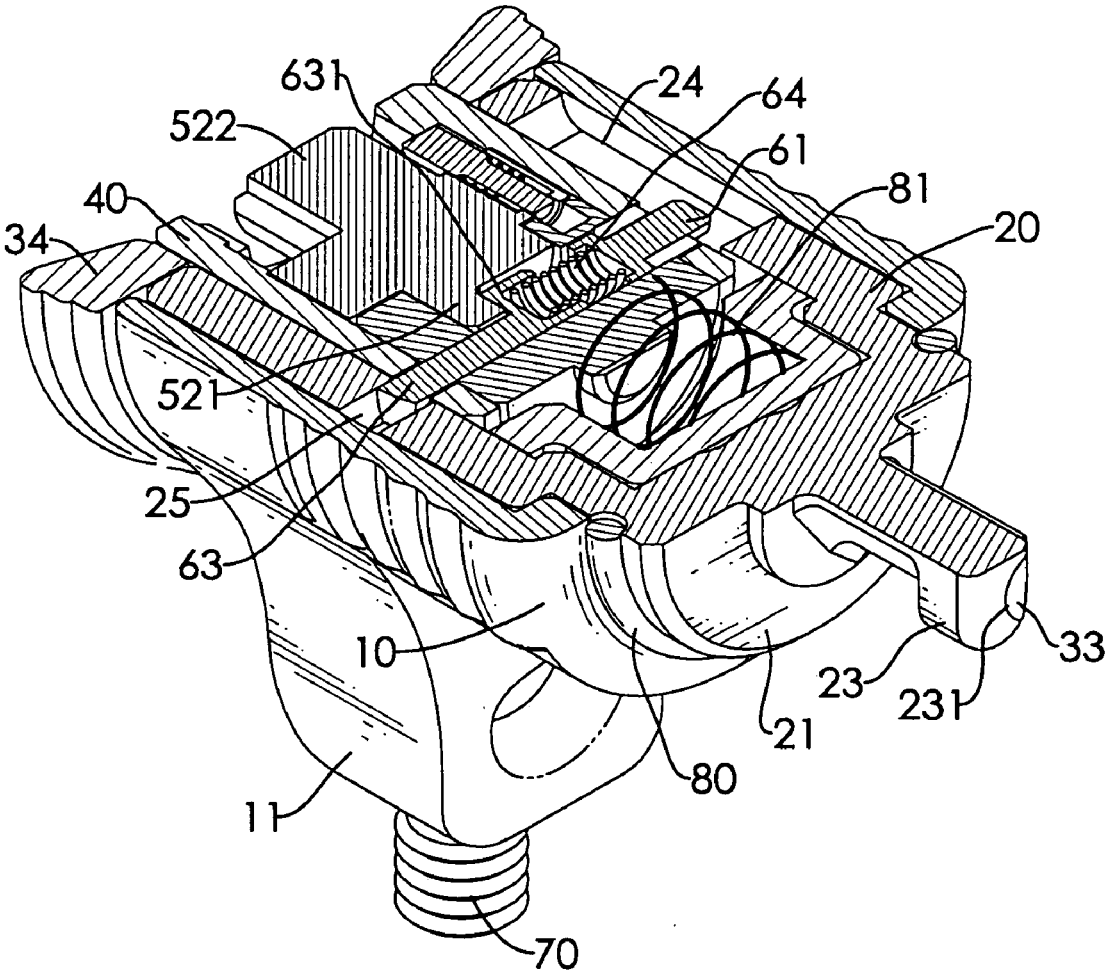
FIG. 5 is a perspective view in partial section of the self-locking cable lock in FIG. 1.
Figure 6:
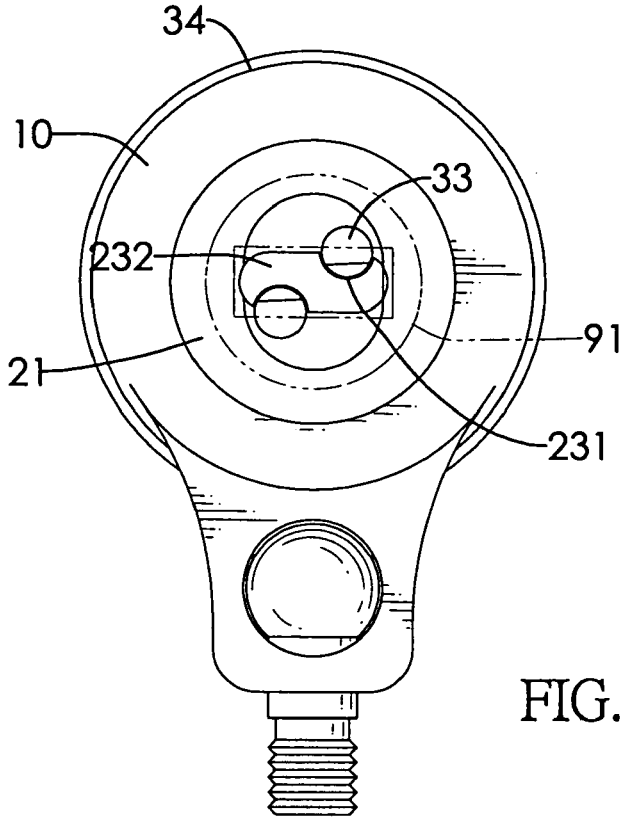
FIG. 6 is a front view of the self-locking cable lock in FIG. 1.
Figure 7:
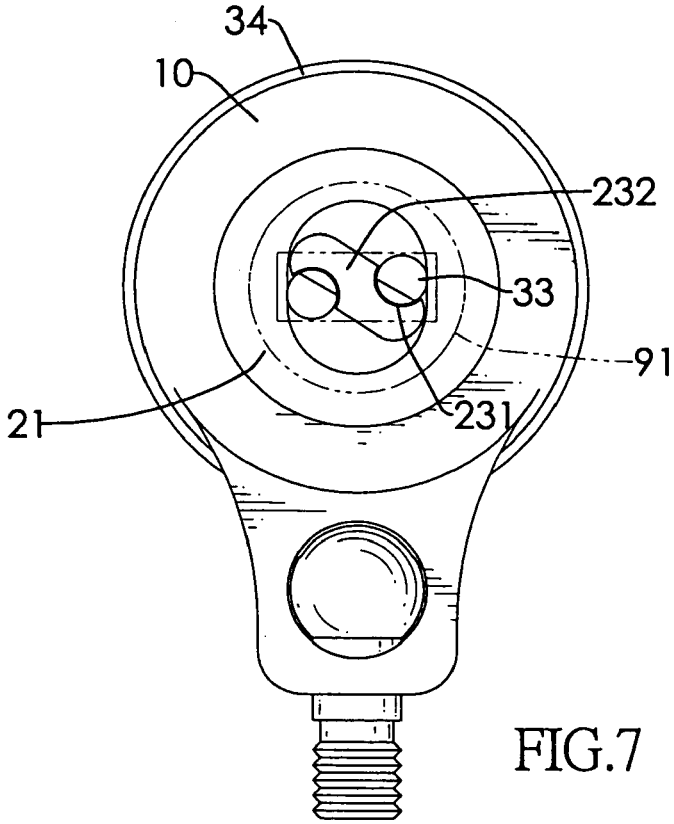
FIG. 7 is an operational front view of the self-locking cable lock in FIG. 6.
Figure 8:
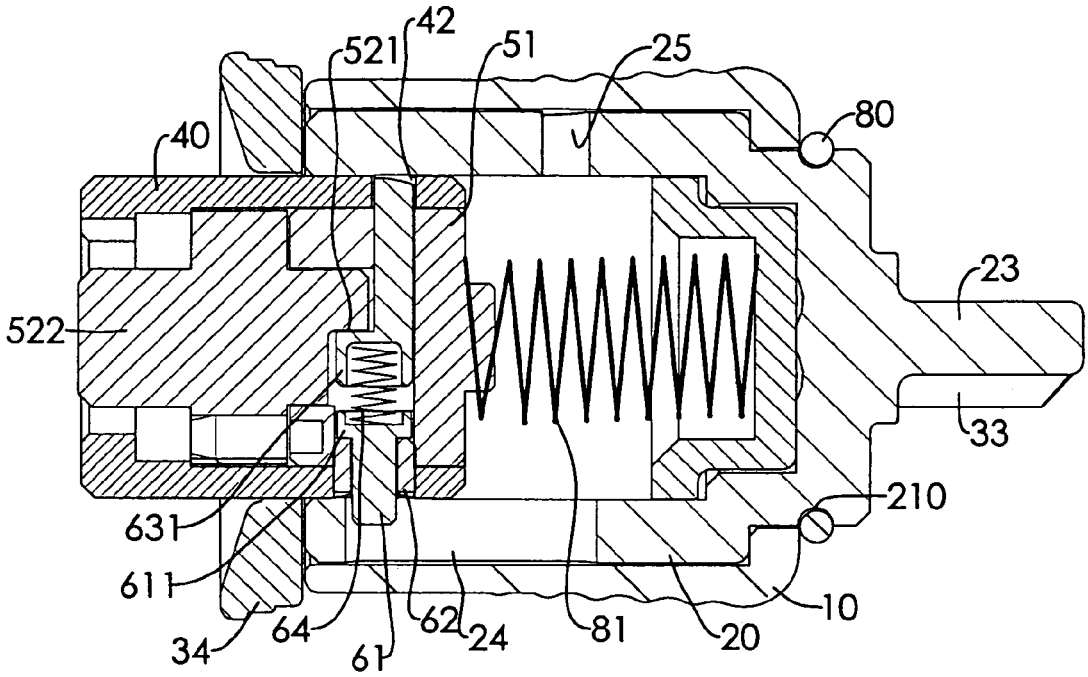
FIG. 8 is a side view in partial section of the self-locking cable lock in FIG. 1 when the cable lock is at an unlocked status.
Figure 9:
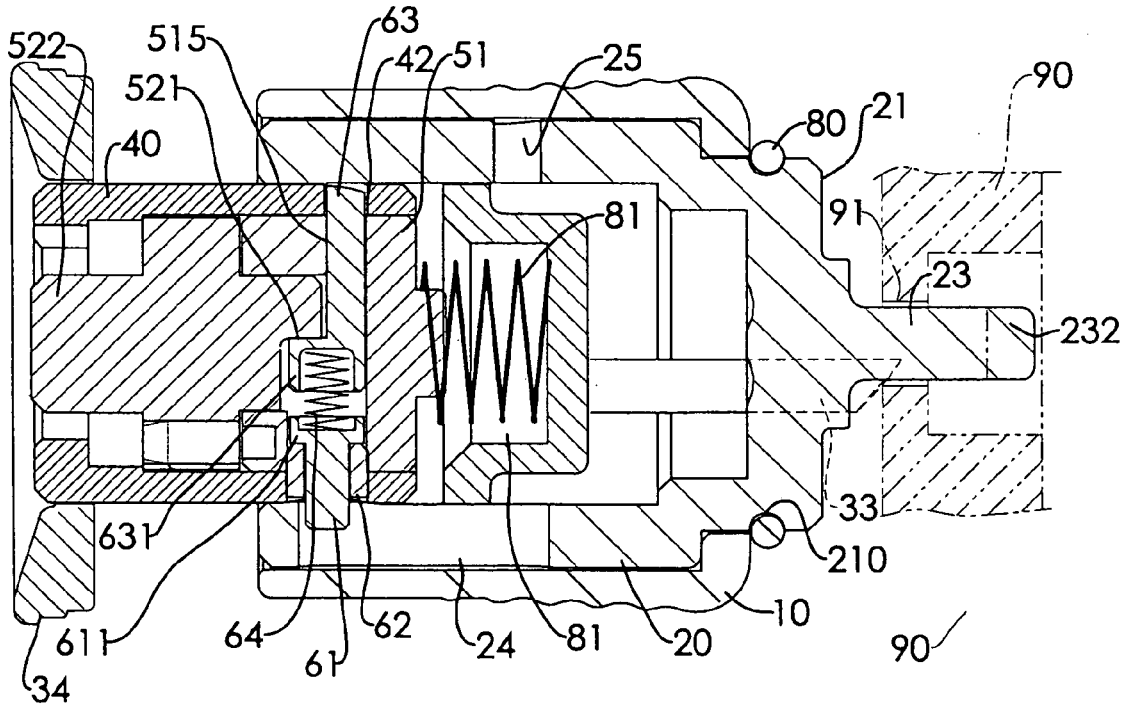
FIG. 9 is an operational side view in partial section of the self-locking cable lock in FIG. 1 when the cable lock is locked with the computer.
Figure 10:
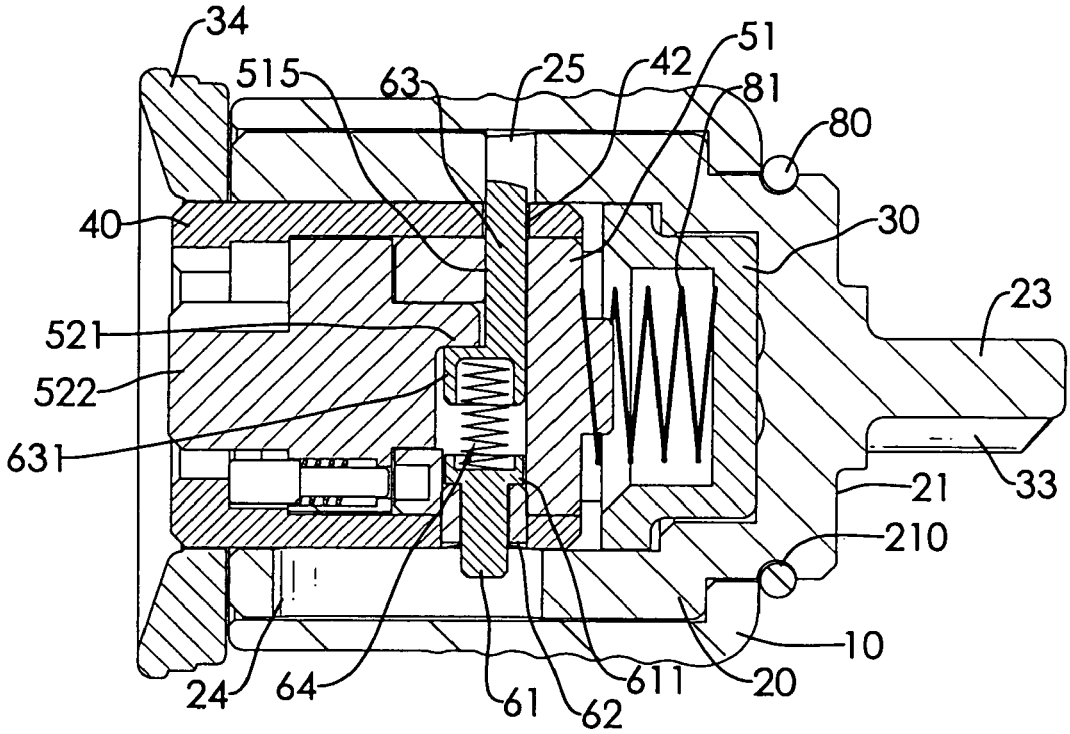
FIG. 10 is a side view in partial section of the self-locking cable lock in FIG. 1 when the cable lock is at a locked status.
Figure 11:
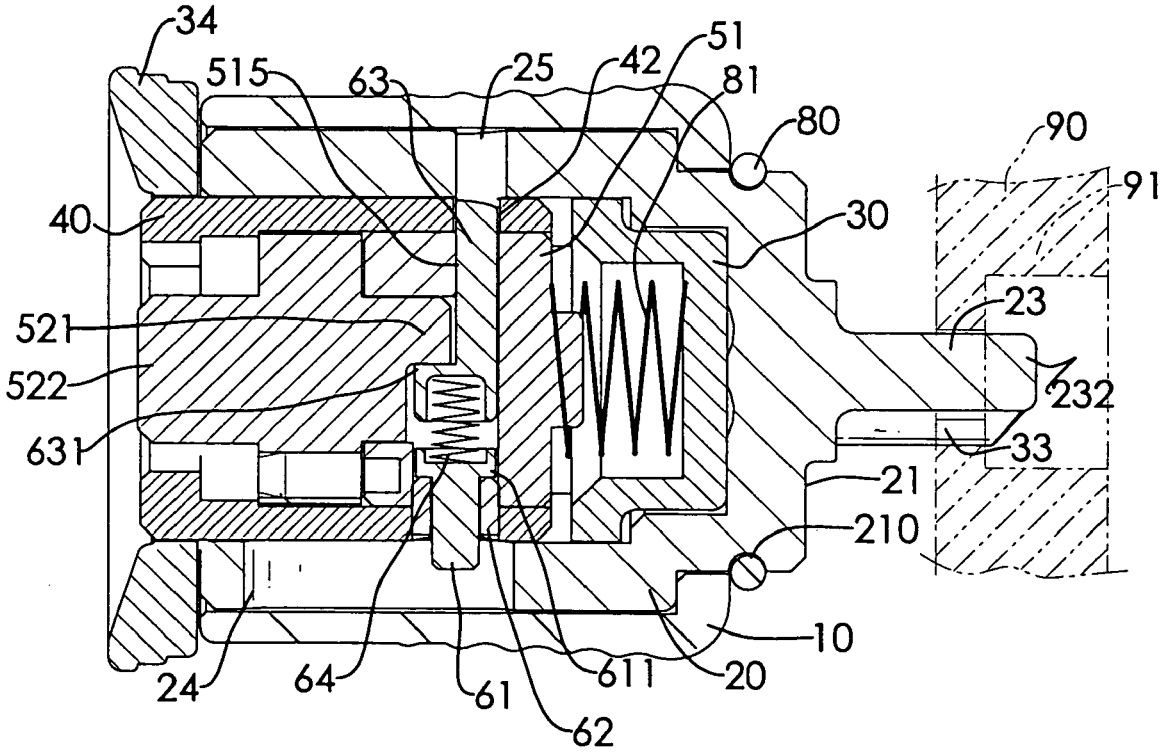
FIG. 11 is an operational side view in partial section of the self-locking cable lock in FIG. 1 when the cable lock is unlocked from the computer.

The external sleeve (20) is mounted rotatably in the main shell (10), is tubular and has a front end, a rear end, an outer wall, an inner wall, a stationary protruding rod (23), two through holes (211), a slot (24) and a passing hole (25). With further reference to FIGS. 3 and 8, the external sleeve (20) may have an annular groove (210), a C-clip (80) and two sector recesses (26). The front end may be a close end (21). The rear end may be an opening end (22). The stationary protruding rod (23) is formed on the front end of the external sleeve (20), extends out of the main shell (10) and has a proximal end, a distal end, an exterior surface, two channels (231) and an optional protrusion (232). The channels (231) are oppositely formed axially in the exterior surface of the stationary protruding rod (23). The protrusion (232) is formed transversely on the distal end of the stationary protruding rod (23). The through holes (211) are formed through the front end of the external sleeve (20) and respectively correspond to the channels (231) in the stationary protruding rod (23). The slot (24) is formed longitudinally in the inner wall of the external sleeve (20). The passing hole (25) is formed through the inner and outer walls of the external sleeve (20) and is opposite to the slot (24). The annular groove (210) is formed around the external sleeve (20) near the front end. The C-clip (80) engages the annular groove (210) to keep the external sleeve (20) from departing from the main shell (10) axially. The sector recesses (26) are formed separately in and extend axially along the inside wall of the external sleeve (20).

The internal sleeve (30) is mounted in the external sleeve (20), is only allowed to move axially with respect to the external sleeve (20) and rotates simultaneously with respect to the external sleeve (20). The internal sleeve (30) has a front end, a rear end, a sidewall, two movable protruding rods (33), an annular flange (34) and two gaps (36). The front end may be a close end (31). The rear end may be an opening end (32). The movable protruding rods (33) are formed separately on the front end of the internal sleeve (30), extend out of the through holes (211) in the external sleeve (21) and are slidably held inside the channels (231) in the stationary protruding rod (23), respectively. Each movable protruding rod (33) has an inclined distal end. The annular flange (34) is formed around the rear end of the internal sleeve (30). The gaps (36) are formed separately in the sidewall of the internal sleeve (30), respectively correspond to the slot (24) and the passing hole (25) in the external sleeve (20) and may divide the sidewall into two sector parts (35). The sector parts (35) respectively correspond to and engage the sector recesses (26) in the external sleeve (20) to allow the internal sleeve (30) moving axially with respect to the external sleeve (20) and rotating simultaneously with the external sleeve (20).

The lock shell (40) is mounted in the internal sleeve (30) and has a sidewall, a through hole (41) and a passing hole (42). The through hole (41) is formed through the sidewall of the lock shell (40) and corresponds to and align with the slot (24) in the external sleeve (20). The passing hole (42) is formed through the sidewall of the lock shell (40) and corresponds to and align with the passing hole (25) in the external sleeve (20).

The lock cylinder (50) is mounted in the lock shell (40) and has a stationary segment (51), a spring (81), a rotatable segment (52) and a locking pin assembly (53).

The stationary segment (51) is tubular, is mounted in the lock shell (40) near the front end and has a front end, a rear end, a sidewall, a through hole (514), a passing hole (515) and an optional protrusion (513). The front end may be a close end (511). The rear end may be an opening end (512). The through hole (514) is formed through the sidewall of the stationary segment (51) and corresponds to and align with the through hole (41) in the lock shell (40). The passing hole (515) is formed through the sidewall of the stationary segment (51) and corresponds to and align with the passing hole (42) in the lock shell (40). The protrusion (513) is formed on the close end (511) of the stationary segment (51). The spring (81) is mounted in the internal sleeve (30), is mounted between the front end of the stationary segment (51) of the lock cylinder (50) and the internal sleeve (30) and may be mounted around the protrusion (513) on the stationary segment (51).

The rotatable segment (52) is mounted in the lock shell (40) near the rear end and has a front end, a rear end, an active turning protrusion (521) and an optional central post (522). The active turning protrusion (521) is semicircular, is formed on the front end of the rotatable segment (52) and extends into the stationary segment (51). The central post (522) is formed on the rear end of the rotatable segment (52).

The locking pin assembly (53) is mounted in the stationary and rotatable segments (51, 52). When the locking pin assembly (53) is locked, the rotatable segment (52) is restricted to be not rotatable with respect to the stationary segment (51). When the locking pin assembly (53) is unlocked, the rotatable segment (52) is allowed to be rotatable with respect to the stationary segment (51).

The lock actuating assembly (60) is mounted in the stationary segment (51) of the lock cylinder (50) and has a guide rod (61), an actuating rod (63), a spring (64) and an optional bearing (62).

The guide rod (61) is mounted in the stationary segment (51) of the lock cylinder (50) and has an outer end, an inner end, an optional head (611) and an optional receiving recess (612). The outer end extends through the through holes (514, 41) of the stationary segment (51) and the lock cylinder (40) and through the gap (36) of the internal sleeve (30) and extends into the slot (24) in the external sleeve (20). The head (611) is formed on the inner end of the guide rod (61). The receiving recess (612) is formed in the inner end of the guide rod (61).

The actuating rod (63) is mounted movably in the stationary segment (51) of the lock cylinder (50) and has an outer end, an inner end, an inactive turning protrusion (631) and an optional receiving recess (632). The outer end extends through the passing holes (515, 42) of the stationary segment (51) and the lock cylinder (40), selectively extends through the gap (36) of the internal sleeve (30) and selectively extends into the passing hole (25) of the external sleeve (20). The inactive turning protrusion (631) is formed on the inner end of the actuating rod (63) and abuts the active turning protrusion (521) of the rotatable segment (52) of the lock cylinder (50). The receiving recess (632) is formed in the inner end of the actuating rod (63) and corresponds to the receiving recess (612) of the guide rod (61).

The spring (64) is mounted between the guide rod (61) and the actuating rod (63) and is attached respectively to the inner ends of the guide rod (61) and the actuating rod (63). The spring (64) may be mounted respectively in the receiving recesses (612, 632) of the guide rod (61) and the actuating rod (63).

The bearing (62) is mounted in the through hole (41) of the lock shell (40) and is mounted around the guide rod (61) to abut the head (611) of the guide rod (61) to keep the guide rod (61) from escaping the through hole (41) of the lock shell (40).

With reference to FIGS. 2 and 3, the lock cylinder (50) is locked and the rotatable segment (52) is not allowed to be rotatable with respect to the stationary segment (51). The outer end of the actuating rod (63) engages the passing hole (25) of the external sleeve (20). Therefore, the lock cylinder (50) is not allowed to move axially with respect to the external sleeve (20). The front end of the stationary segment (51) of the lock cylinder (50) presses against the spring (81) to keep the internal sleeve (30) from moving axially with respect to the external sleeve (20).

With reference to FIGS. 2, 4, 8 and 11, inserting a proper key to unlock the lock cylinder (50) allows the rotatable segment (52) to be rotatable with respect to the stationary segment (51). When the rotatable segment (52) rotates, the actuating rod (63) is retracted into the lock shell (40) to leave the passing hole (25) of the external sleeve (20) because the active turning protrusion (521) of the rotatable segment (52) abuts the inactive turning protrusion (631) of the actuating rod (63). Then the lock shell (40) and the lock cylinder (50) are pushed by the spring (81) to extend out of the external sleeve (20) from the rear end. Because the guide rod (61) extends through the through holes (514, 41) of the lock shell (40) and the stationary segment (51) and extends into the slot (24) in the external sleeve (20), the lock shell (40) and the lock cylinder (50) only can move axially with respect to the external sleeve (20).

With reference to FIGS. 2 and 6–11, the cable lock as described is pushed to lock into a keyhole (91) in a desired appliance (90). The keyhole (91) of the desired appliance (90) is a step hole to alternatively allow the stationary protruding rod (23) or the movable protruding rods (23) to pass through. The stationary protruding rod (23) is inserted into the keyhole (91). When the movable protruding rods (33) contact with the appliance (90), the internal sleeve (30) is pushed to extend out of the internal sleeve (20). When the internal sleeve (30) can not be pushed backward any more, the inclined distal ends of the movable protruding rods (33) slides along the appliance (90) to self rotate the internal sleeve (30) and the external sleeve (20) is rotated simultaneously. Therefore, the movable protruding rods (33) are allowed to extend into the keyhole (91) and the cable lock engages the keyhole (91). After the engagement, the lock shell (40) and the lock cylinder (50) is pushed into the external sleeve (20) to mount the lock shell (40) and the lock cylinder (50) securely in the external sleeve (20). Then the cable lock is locked in the keyhole (91).

The advantage of the present invention as discussed below. With the protruding rods (23, 33) on the external and internal sleeves (20, 30) and the simultaneously rotating between the external and internal sleeve (20, 30), the cable lock can be self locking into the keyhole (91) without the proper key. Being self locking for the cable lock is more convenient.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A self-locking cable lock comprising:

a cable;

a main shell attached to the cable and being tubular;

an external sleeve mounted rotatably in the main shell, being tubular and having a front end;

a rear end;

an outer wall;

an inner wall;

a stationary protruding rod formed on the front end of the external sleeve, extending out of the main shell and having a proximal end;

a distal end;

an exterior surface; and two channels oppositely formed axially in the exterior surface of the stationary protruding rod;

two through holes formed through the front end of the external sleeve and respectively corresponding to the channels in the stationary protruding rod;

a slot formed longitudinally in the inner wall of the external sleeve; and a passing hole formed through the inner and outer walls of the external sleeve and being opposite to the slot;

an internal sleeve mounted in the external sleeve, moveably with respect to the external sleeve, rotating simultaneously with the external sleeve and having a front end;

a rear end;

a sidewall;

two movable protruding rods formed separately on the front end of the internal sleeve, extending out of the through holes in the external sleeve and slidably held respectively in the channels in the stationary protruding rod, and each movable protruding rod having an inclined distal end;

an annular flange formed around the rear end of the internal sleeve; and two gaps formed separately in the sidewall of the internal sleeve and respectively corresponding to the slot and the passing hole in the external sleeve;

a lock shell mounted in the internal sleeve and having a sidewall;

a through hole formed through the sidewall of the lock shell and corresponding to and aligning with the slot in the external sleeve; and a passing hole formed through the sidewall of the lock shell corresponding to and aligning with the passing hole in the external sleeve;

a lock cylinder mounted in the lock shell and having a stationary segment being tubular, mounted in the lock shell near the front end and having a front end;

a rear end;

a sidewall;

a through hole formed through the sidewall of the stationary segment and corresponding to and aligning with the through hole in the lock shell; and a passing hole formed through the sidewall of the stationary segment and corresponding to and aligning with the passing hole in the lock shell;

a spring mounted in the internal sleeve and mounted between the front end of the stationary segment of the lock cylinder and the internal sleeve;

a rotatable segment mounted in the lock shell near the rear end and having a front end;

a rear end; and an active turning protrusion being semicircular, formed on the front end of the rotatable segment and extending into the stationary segment; and a locking pin assembly mounted in the stationary and rotatable segments, wherein when the locking pin assembly is locked, the rotatable segment is restricted to be keep from rotatable with respect to the stationary segment and when the locking pin assembly is unlocked, the rotatable segment is allowed to be rotatable with respect to the stationary segment; and a lock actuating assembly mounted in the stationary segment of the lock cylinder and having a guide rod mounted in the stationary segment of the lock cylinder and having an outer end extending through the through holes of the stationary segment and the lock cylinder and through one of the gaps of the internal sleeve and extending into the slot in the external sleeve; and an inner end;

an actuating rod mounted movably in the stationary segment of the lock cylinder and having an outer end extending through the passing holes of the stationary segment and the lock cylinder, selectively extending through one of the gaps of the internal sleeve and selectively extending into the passing hole of the external sleeve;

an inner end; and an inactive turning protrusion formed on the inner end of the actuating rod and abutting the active turning protrusion of the rotatable segment of the lock cylinder; and a spring mounted between the guide rod and the actuating rod and attached respectively to the inner ends of the guide rod and the actuating rod.

2. The self-locking cable lock as claimed in claim 1, wherein the front ends of the external sleeve, the internal sleeve and the stationary segment of the lock cylinder are close ends; and the rear ends of the external sleeve, the internal sleeve and the stationary segment of the lock cylinder are opening ends.

3. The self-locking cable lock as claimed in claim 2, wherein the external sleeve has two sector recesses formed separately in and extend axially along the inside wall of the external sleeve; and the gaps of the internal sleeve divides the sidewall of the internal sleeve into two sector parts respectively corresponding to and engaging the sector recesses in the external sleeve to allow the internal sleeve moving axially with respect to the external sleeve and rotating simultaneously with respect to the external sleeve.

4. The self-locking cable lock as claimed in claim 3, wherein the external sleeve has an annular groove formed around the external sleeve near the front end; and a C-clip engaging the annular groove to keep the external sleeve from departing from the main shell axially.

5. The self-locking cable lock as claimed in claim 4, wherein the guide rod has a head formed on the inner end of the guide rod; and the lock actuating assembly has a bearing mounted in the through hole of the lock shell and mounted around the guide rod to abut the head of the guide rod to keep the guide rod from escaping the through hole of the lock shell.

6. The self-locking cable lock as claimed in claim 5, wherein the guide rod has a receiving recess formed in the inner end of the guide rod;

the actuating rod has a receiving recess formed in the inner end of the actuating rod and corresponding to the receiving recess of the guide rod; and the spring of the lock actuating assembly mounted respectively in the receiving recesses of the guide rod and the actuating rod.

7. The self-locking cable lock as claimed in claim 6, wherein the stationary protruding rod of the external sleeve has a protrusion formed transversely on the distal end of the stationary protruding rod.

8. The self-locking cable lock as claimed in claim 7, wherein the rotatable segment of the lock cylinder has a central post formed on the rear end of the rotatable segment.

9. The self-locking cable lock as claimed in claim 8, wherein the main shell has two opening ends;

a sidewall; and a joint formed on the sidewall of the main shell and attach to the cable.

* * * * *